US006871426B2

(12) United States Patent
Keech et al.

(10) Patent No.: US 6,871,426 B2
(45) Date of Patent: Mar. 29, 2005

(54) LOCKING ASSEMBLY AND METHOD

(76) Inventors: David Kim Keech, 7 Egerton Street, Silverwater, New South Wales (AU), 2128; Alexander Hand, 3 Laurette Drive, Glenore Grove (AU), 4342

( * ) Notice: Subject to any disclaimer, the term of this patent is extended or adjusted under 35 U.S.C. 154(b) by 0 days.

(21) Appl. No.: 10/481,361

(22) PCT Filed: Jun. 18, 2002

(86) PCT No.: PCT/AU02/00790

§ 371 (c)(1),
(2), (4) Date: Dec. 18, 2003

(87) PCT Pub. No.: WO02/103122

PCT Pub. Date: Dec. 27, 2002

(65) Prior Publication Data

US 2004/0148821 A1 Aug. 5, 2004

(30) Foreign Application Priority Data

Jun. 18, 2001 (AU) ..... PR5767

(51) Int. Cl.[7] ..... E02F 9/28
(52) U.S. Cl. ..... 37/456
(58) Field of Search ..... 37/452, 453, 455–459; 403/376, 380

(56) References Cited

U.S. PATENT DOCUMENTS 4,748,754 A 6/1988 Schwappach
5,088,214 A 2/1992 Jones
5,438,774 A 8/1995 Fletcher et al.
5,966,849 A 10/1999 Moehnke et al.
6,085,448 A 7/2000 Gale et al.

FOREIGN PATENT DOCUMENTS

AU 54935/94 9/1994

*Primary Examiner*—Robert E Pezzuto
(74) *Attorney, Agent, or Firm*—Tucker Ellis & West LLP

(57) ABSTRACT

A locking arrangement (1) for releasably locking a wear tooth (2) to a tooth adaptor (3); the wear tooth (2) being defined by a top wall, a bottom wall and a pair of opposed sidewalls, each sidewall having an elongate slot (5) therethrough; the tooth adaptor (3) being of generally complementary shape to receive said wear tooth (2), and having an elongate cavity (6) on each opposed side thereof adapted to substantially align with a respective slot (5) of said wear tooth (2) when said wear tooth is installed on said tooth adaptor; said slot having a first inner surface, the locking arrangement including a retaining means (4) to be installed in each aligned cavity and slot to releasably lock said tooth (2) to said adaptor (3), the retaining means (4) including a pair of engaging retaining pieces (7, 8) adapted to fit in end-abutting relationship when in said locked position, whereby, an arcuate force is applied to at least one of said pieces (7, 8) to release said pieces from said locked position.

18 Claims, 15 Drawing Sheets

LOCKING ASSEMBLY AND METHOD

BACKGROUND OF THE INVENTION

The present invention relates to a locking assembly and to a method of locking a wear tooth to a tooth adaptor, typically utilised in the mining, agricultural, or other earthmoving industries.

In particular, the present invention relates to a locking assembly which, by provision of a retaining means in a dual part format, various advantages are achieved.

DESCRIPTION OF THE PRIOR ART

The reference to any prior art in this specification is not, and should not be taken as, an acknowledgement or any form of suggestion that that prior art forms part of the common general knowledge in Australia Various locking arrangements are presently known, for locking one or more wear tooth to it's respective tooth adaptor(s).

Traditionally, such teeth are welded to the tooth adaptor such that as the tooth wears out, the old tooth is removed and replaced by a new tooth, which is welded into position.

In more recent times, various methods for the removable attachment of such teeth and other wear plates have been developed, eliminating welding operations. All such systems, however, generally include at least one through hole or orifice on a vertical or horizontal plane, through which a pin is inserted, however, such systems have the disadvantage that the strength of the devices are compromised.

SUMMARY OF THE INVENTION

The present invention seeks to provide a locking assembly for releasably retaining a wear tooth to a tooth adaptor which provides certain advantages, or at least an alternative to presently known assemblies.

The present invention seeks to provide a locking assembly which enables a quick and easy secure locking and unlocking of the various components to be achieved.

In one broad form, the present invention provides a locking arrangement for releasably locking a wear tooth to a tooth adaptor; the wear tooth having an elongate slot provided in a wall thereof; the tooth adaptor being of generally complementary shape to receive said wear tooth, and having an elongate cavity adapted to substantially align with a respective slot of said wear tooth when said wear tooth is installed on said tooth adaptor; said slot having a first inner surface, the locking arrangement including a retaining means to be installed in each aligned cavity and slot to releasably lock said tooth to said adaptor, the retaining means including separate engaging retaining pieces adapted to fit in end-abutting relationship when in said locked position, whereby, an arcuate force is applied to at least one of said pieces to release said pieces from said locked position.

Preferably, at least one of said retaining pieces is formed at least partly of an elastomeric material.

Also preferably, a second end of a first retaining piece is formed at least partly from an elastomeric material.

Preferably, a first end of said first retaining piece is provided with a protruding portion adapted to retain a rearwardly positioned lip provided on a first end of a second retaining piece when in said locked position, whereby, to release said pieces from said locked position, said second piece is pivoted about its second end by applying a force in an arcuate manner to said second retaining piece, such that said elastomeric material is at least partly compressed and said lip is moved forwardly past said protrusion.

Also preferably, said second retaining piece is formed with an orifice thereon adapted to receive a lever therein via said slot, such that said arcuately directed form may be applied for release of said retaining pieces.

Preferably, said second retaining piece includes a striking pad, for imparting a striking force thereto to engage said retaining pieces in said locked position.

Also preferably, said first end of second retaining piece includes a forward portion abutting said first inner surface of said wear tooth slot, such that said forward portion is releasably-retained in a forward direction when said retainer pieces are in said locked position, In a most preferred form, the present invention provides a locking arrangement for releasably locking a wear tooth to a tooth adaptor, the wear tooth being defined by a top wall, a bottom wall and a pair of opposed sidewalls, each sidewall having an elongate slot therethrough; the tooth adaptor being of generally complementary shape to receive said wear tooth, and having an elongate cavity on each opposed side thereof adapted to substantially align with a respective slot of said wear tooth when said wear tooth is installed on said tooth adaptor; said slot having a first inner surface, the locking arrangement including a retaining means to be installed in each aligned cavity and slot to releasably lock said tooth to said adaptor, the retaining means including a pair of engaging retaining pieces adapted to fit in end-abutting relationship when in said locked position, whereby, an arcuate force is applied to at least one of said pieces to release said pieces from said locked position.

In another broad form, the present invention provides a locking arrangement for releasably locking a wear tooth to a tooth adaptor; wherein

- the wear tooth includes an elongate slot provided in a wall thereof having a first inner surface;
- the tooth adaptor being of generally complementary shape to receive said wear tooth, and having an elongate cavity adapted to substantially align with a respective slot of said wear tooth when said wear tooth is installed on said tooth adaptor;
- the locking arrangement including
  - retaining pieces;
  - a rigid bracket piece (bridge) extending across a portion of the adaptor slot, and
- a locking piece which communicates with, and releasably locks, said retaining pieces relative to each other in an end-abutting relationship when installed in each aligned cavity and slot, wherein said bracket piece substantially restrains the releasably locked retaining pieces in the wear tooth slot and tooth adaptor cavity.

Preferably the said retainer pieces includes a first retainer piece and a second retaining piece.

Preferably the first retainer piece includes a threaded slot or hole for receiving the locking piece.

Preferably the second retainer piece includes a threaded slot or hole for receiving the locking piece.

Preferably the locking piece is a threaded screw.

Preferably a first end of said first retaining piece is provided with a protruding portion for receiving a rearwardly positioned lip provided on a first end of said second retaining piece when in said locked position.

Preferably the first retainer piece threaded slot and the second retainer piece threaded slot are substantially aligned for mutually receiving the locking piece when retaining pieces are installed in the wear tooth slots and tooth adaptor cavity in the locked position.

Preferably the rigid bracket piece is removably mounted to the adaptor.

Preferably the rigid bracket piece extends transversely across a portion of the adaptor slot.

BRIEF DESCRIPTION OF THE DRAWINGS

The present invention will be become more fully understood from the following detailed description of preferred but non-limiting embodiments, described in connection with the accompanying drawings, wherein.

DETAILED DESCRIPTION OF PREFERRED EMBODIMENTS

Figure 1:
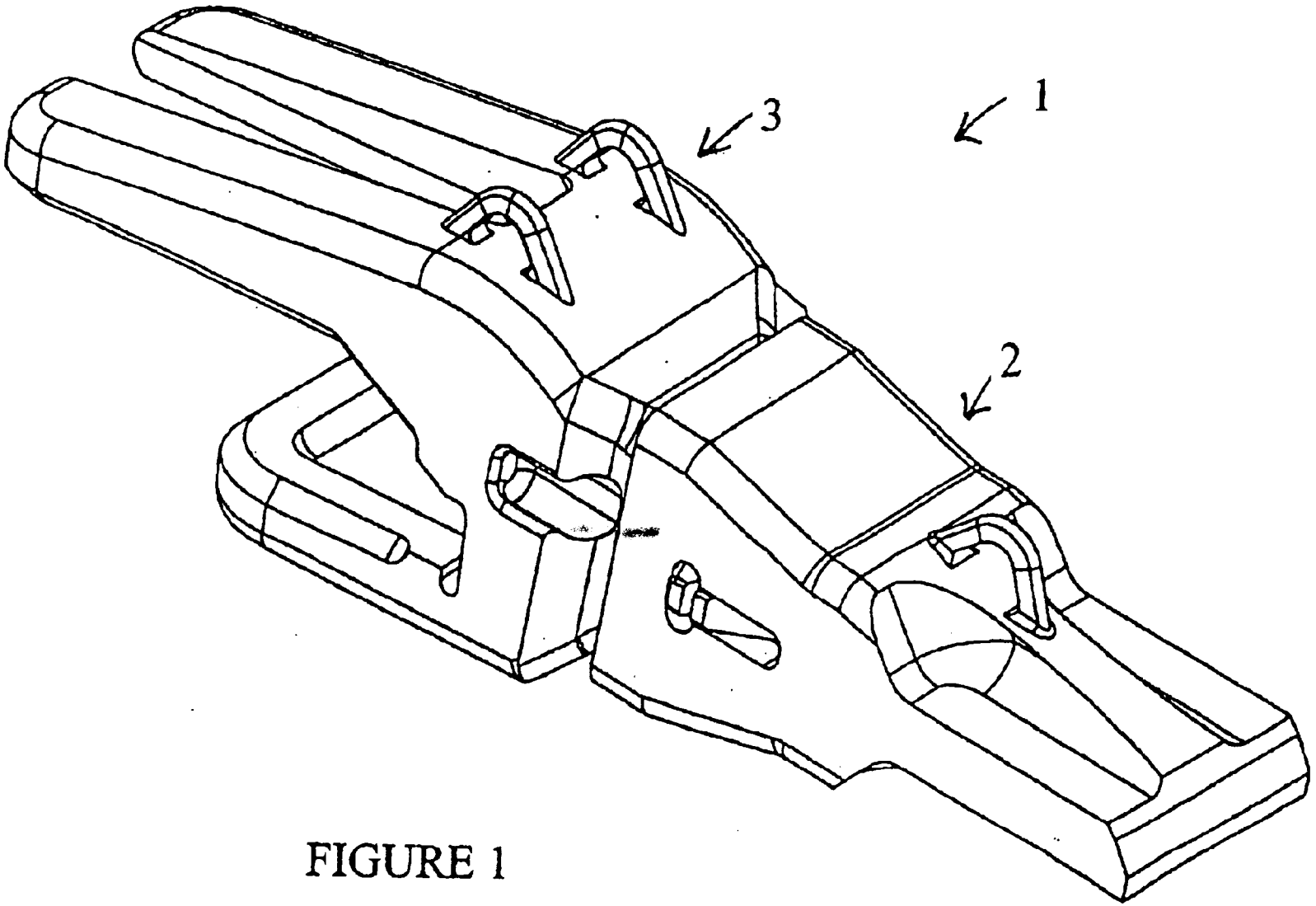
FIG. 1 illustrates an isometric view of a first embodiment of the locking assembly in accordance with the present invention in its assembled position.
Figure 2:
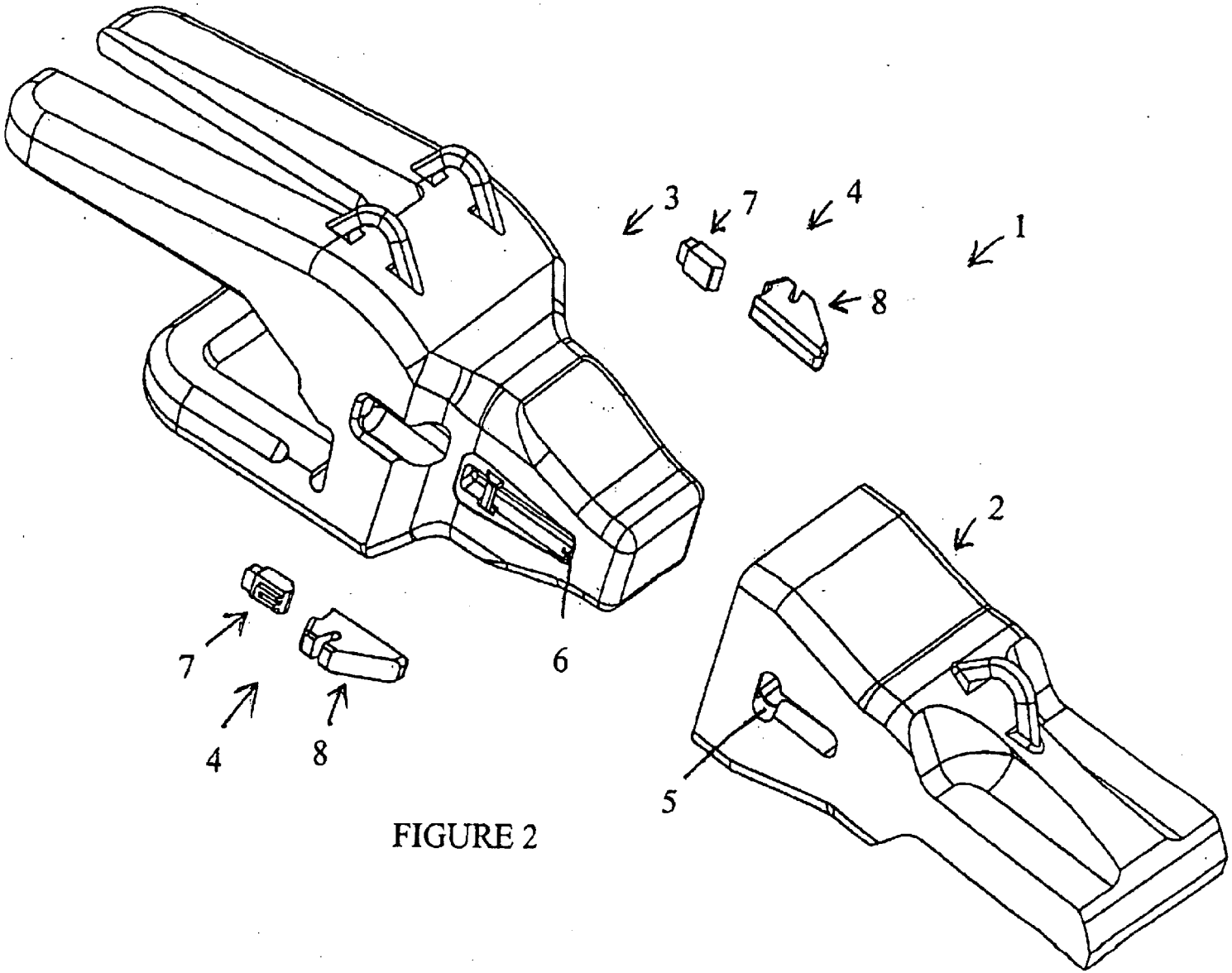
FIG. 2 illustrates an isometric view of the locking assembly in an exploded form.
Figure 3:
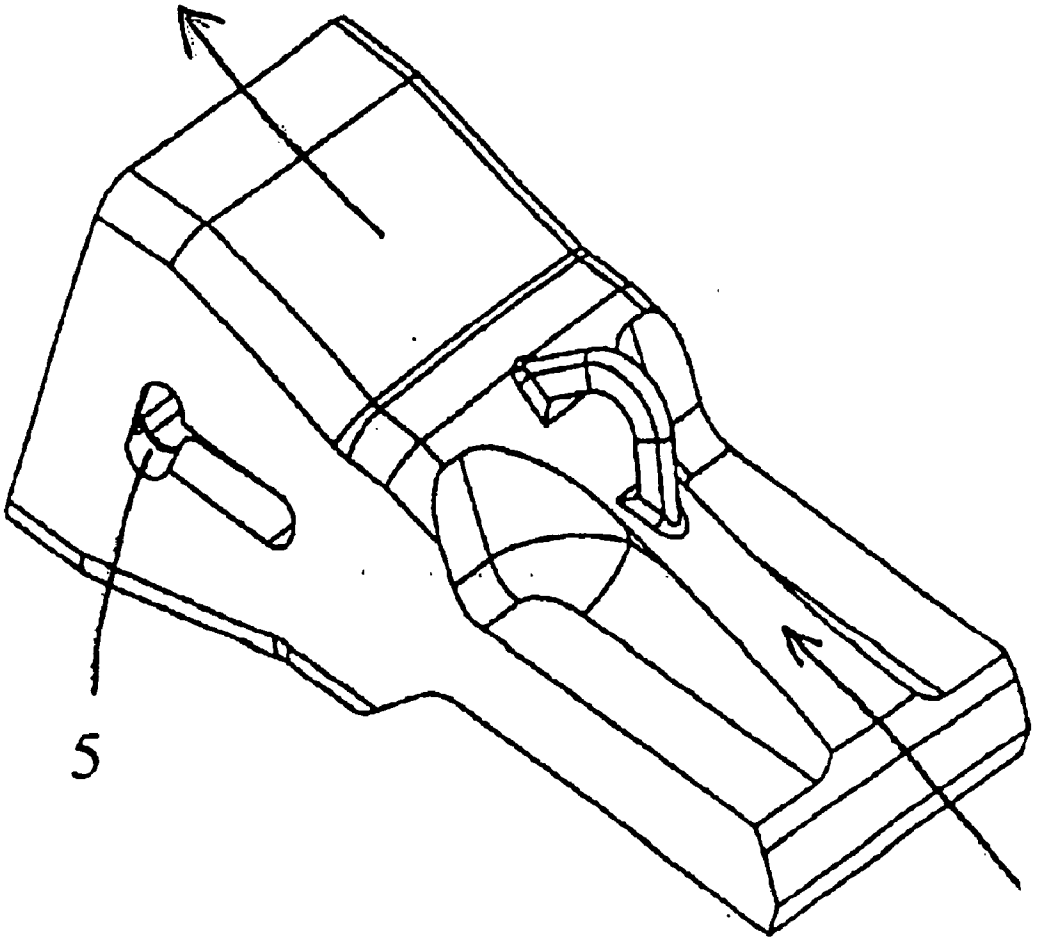
FIG. 3 details the wear tooth.
Figure 4:
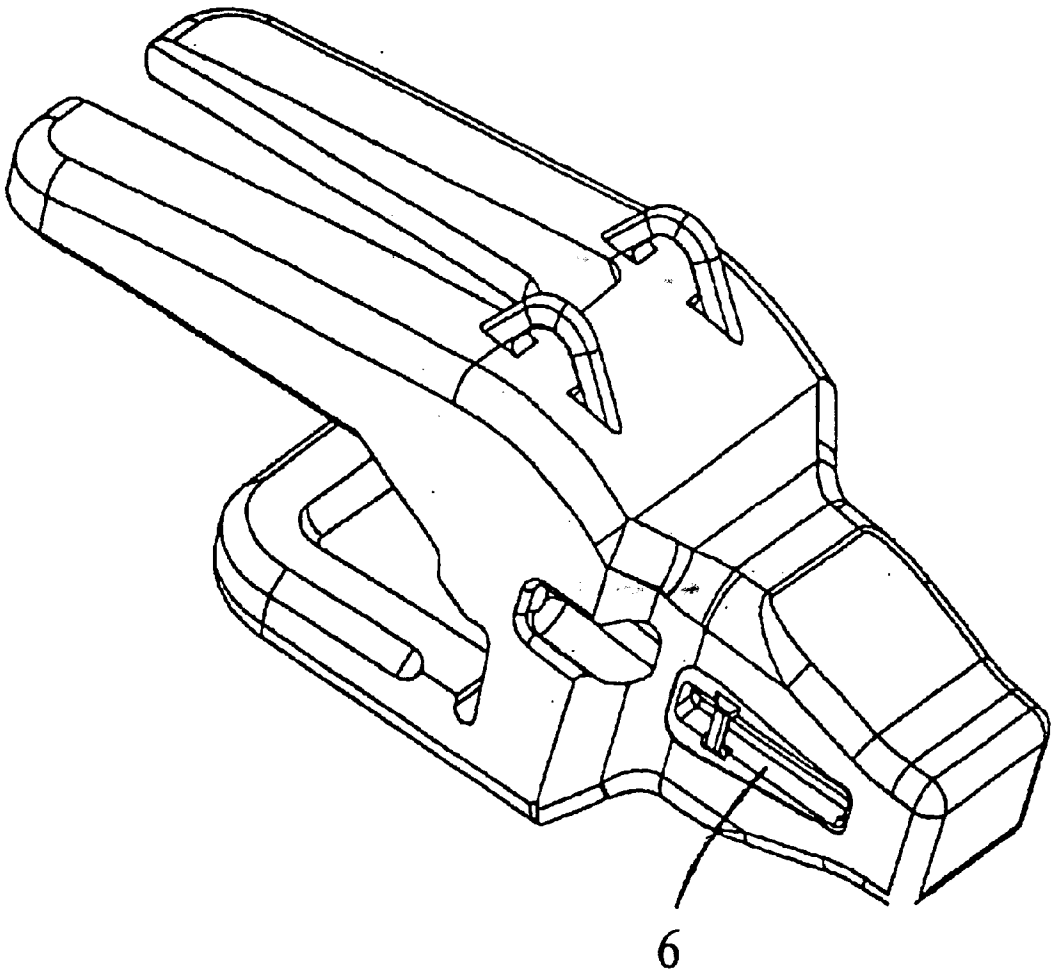
FIG. 4 details the tooth adaptor.
Figures 5A, 5B:
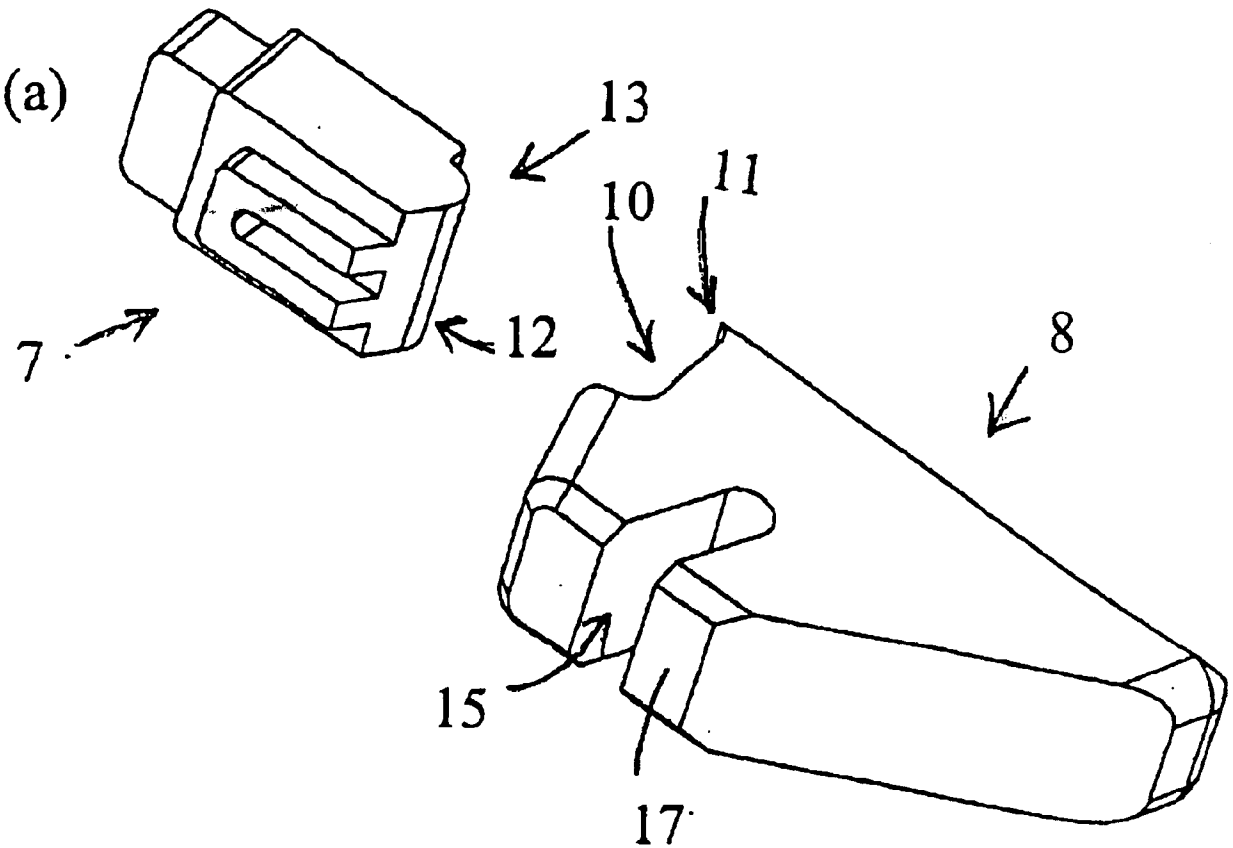
FIG. 5 illustrates the two part retaining means, FIG. 5(*a*) illustrating a first part and FIG. 5(*b*) illustrating a second part.
Figure 6:
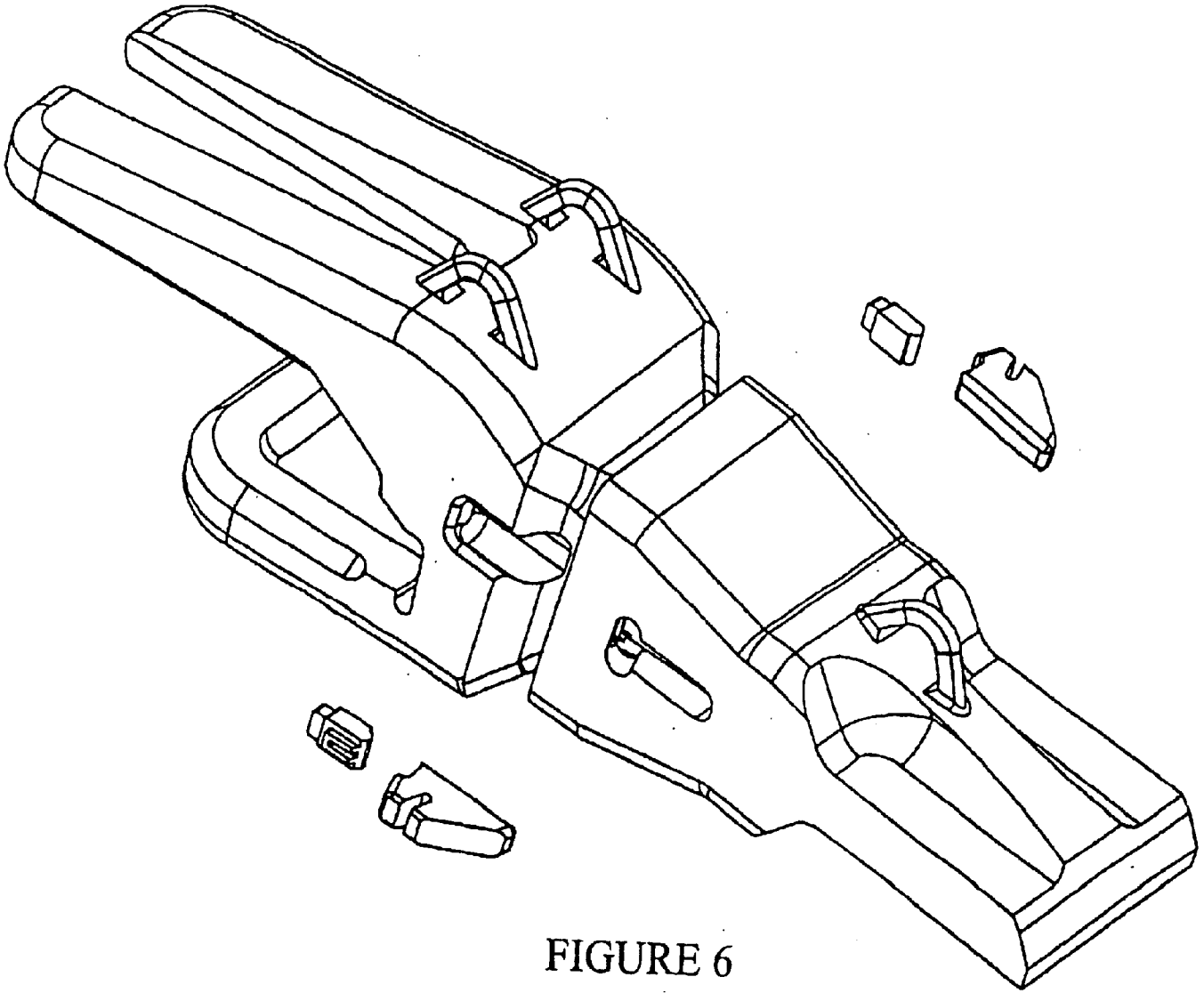
FIG. 6 illustrates a partly exploded view of the assembly, with the tooth connector to the tooth adaptor ready for insertion of the retaining means.

Throughout the drawings, like numerals will be used to identify similar features, except where expressly otherwise indicated.

As shown in FIGS. 1 to 10 of the drawings, a locking assembly, generally designated by the numeral 1, include a wear tooth 2 adapted to be retained on a tooth adaptor 3 by means of retaining means, which generally designated by the numeral 4. As will be readily observed from the drawings, the locking assembly of this embodiment of the present invention is characterised by being provided with at least one, but preferably two, slots 5, in the or each side portions of the tooth 2, such that they cooperate with corresponding slots 6 in each side of the tooth adaptor when in the engaged position, to then receive retaining means 4.

The retaining means 4 of the present invention includes a pair of cooperating parts, a first part 7 having a shaped edge surface adapted to cooperate with a complementary shaped edge surface of second part 8. The shaped edge surface 10 of the second part 8 of the retaining means 4 is provided with a lip 11 adapted to be provided rearwardly of a protruding part 12 of the shaped edge surface 13 of the first part 7 of retaining means 4, as detailed in FIG. 5.

Figure 7:
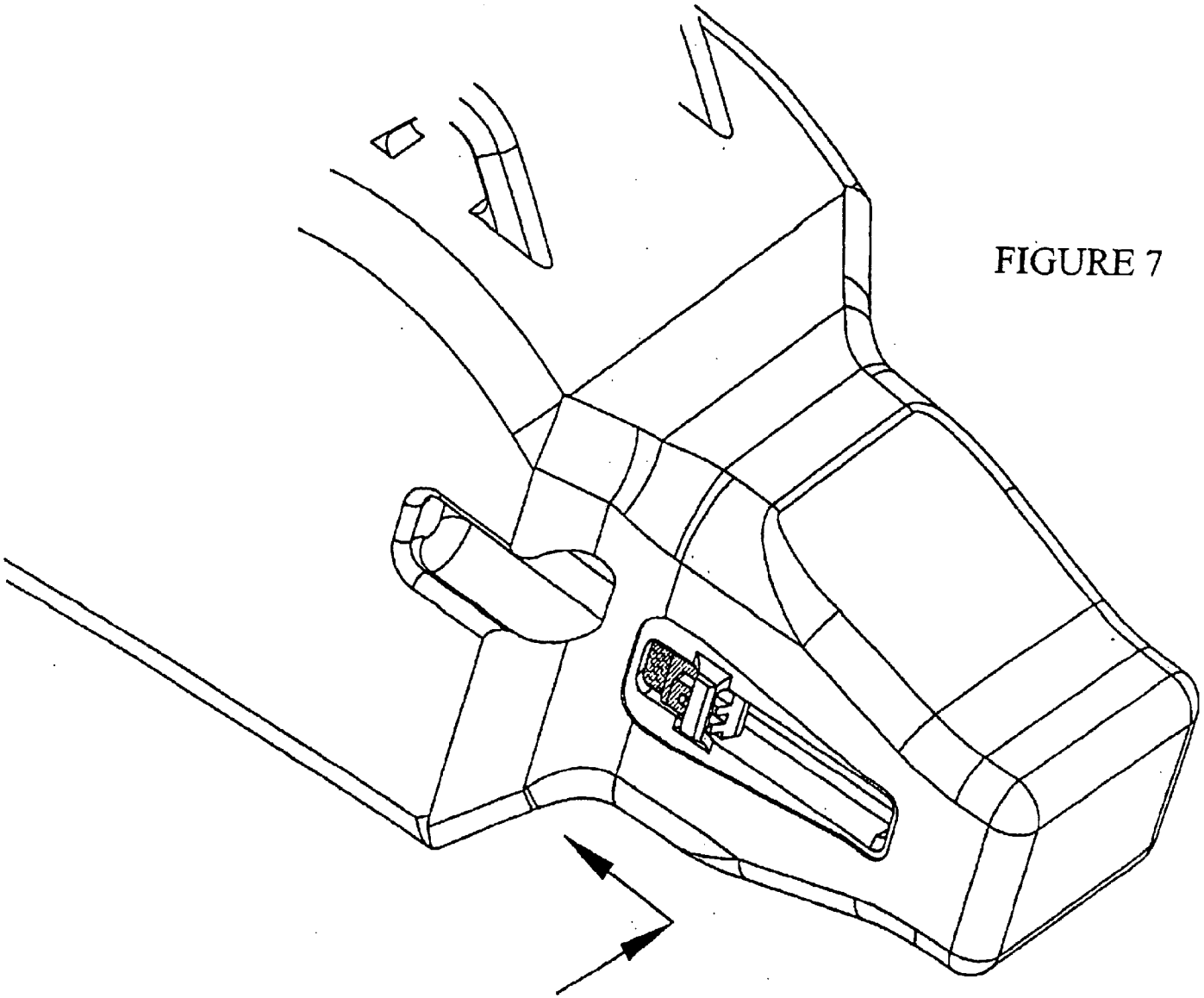
FIG. 7 illustrates a first step of the insertion of the retaining means.
Figure 8:
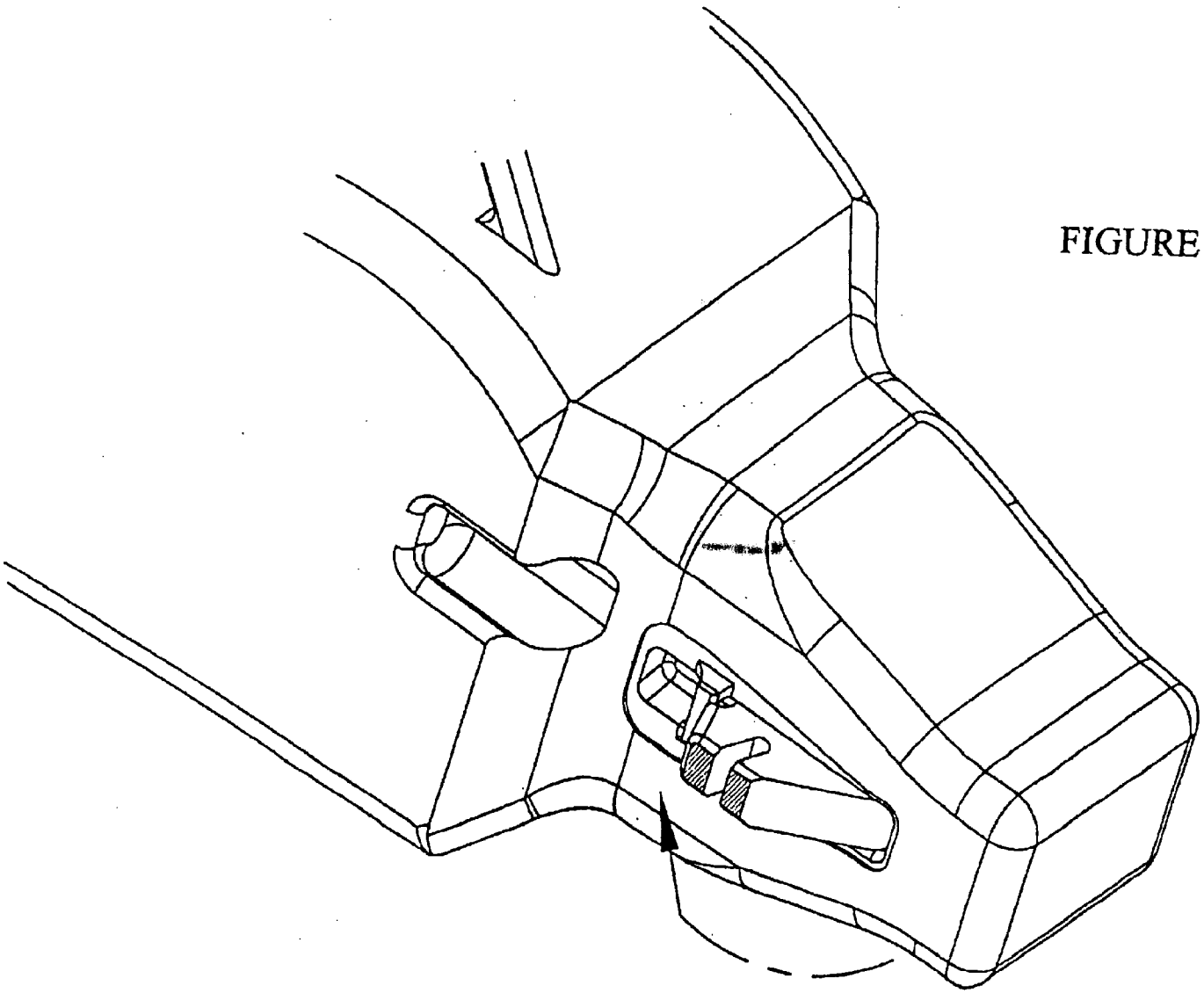
FIG. 8 illustrates a similar view to FIG. 7, showing a second step in the insertion of the retaining means.
Figure 9:
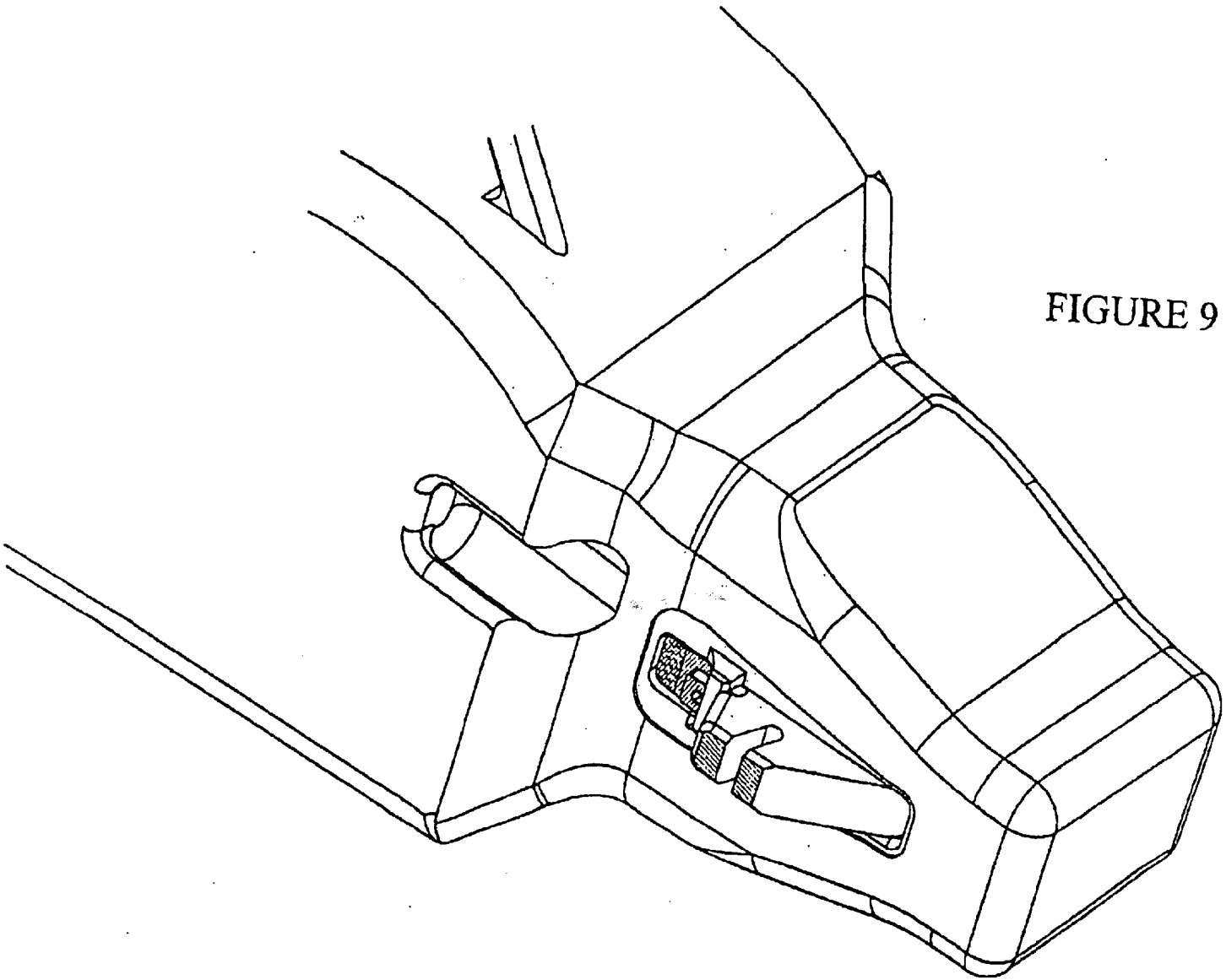
FIG. 9 illustrates the retaining means inserted into position.
Figure 10:
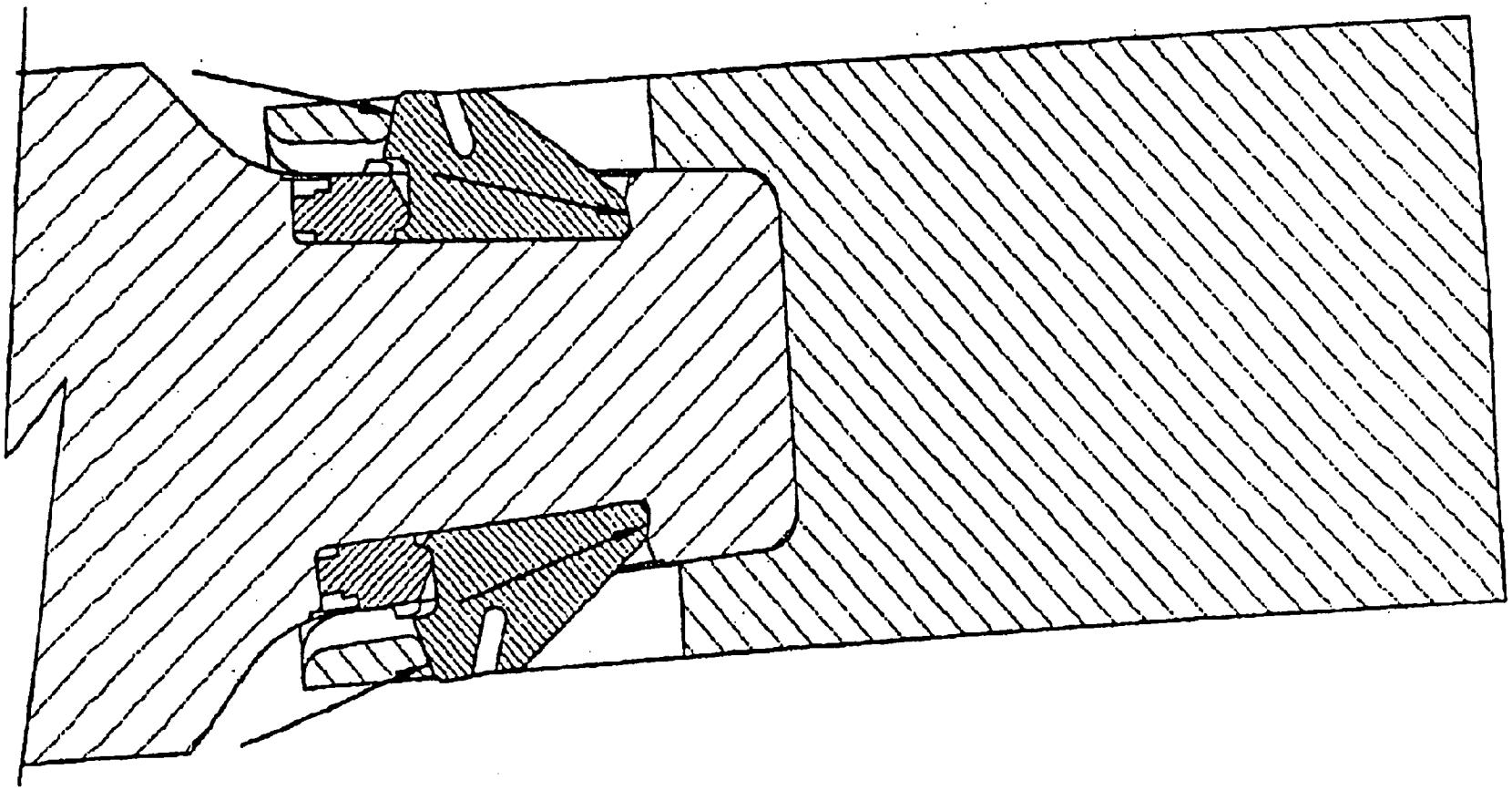
FIG. 10 illustrates the forces inherent in the device shown in FIGS. 1 to 9, when in use.
Figure 11A:
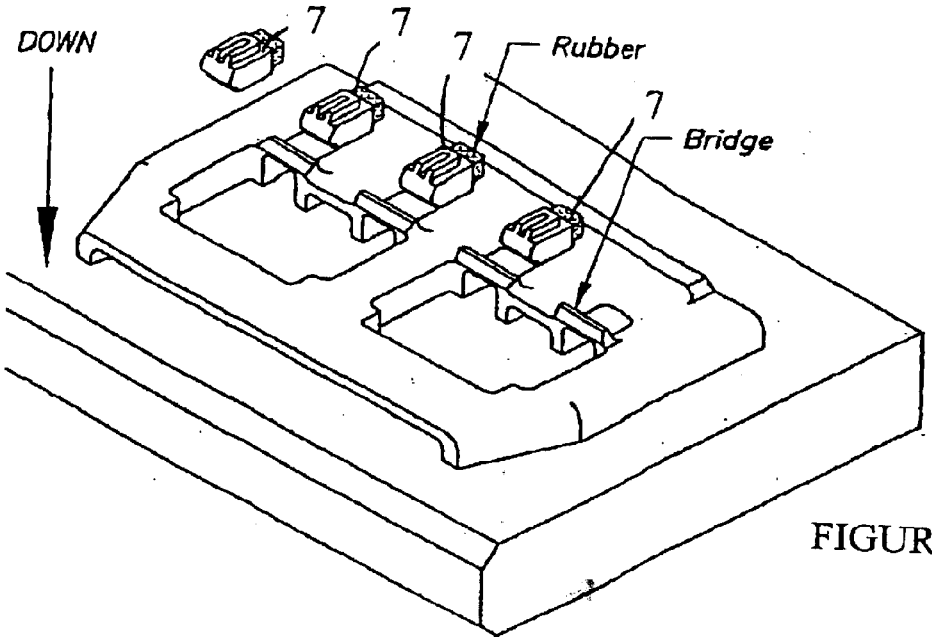
FIG. 11 illustrates a second embodiment of the locking mechanism device of the present invention.
Figure 11B:
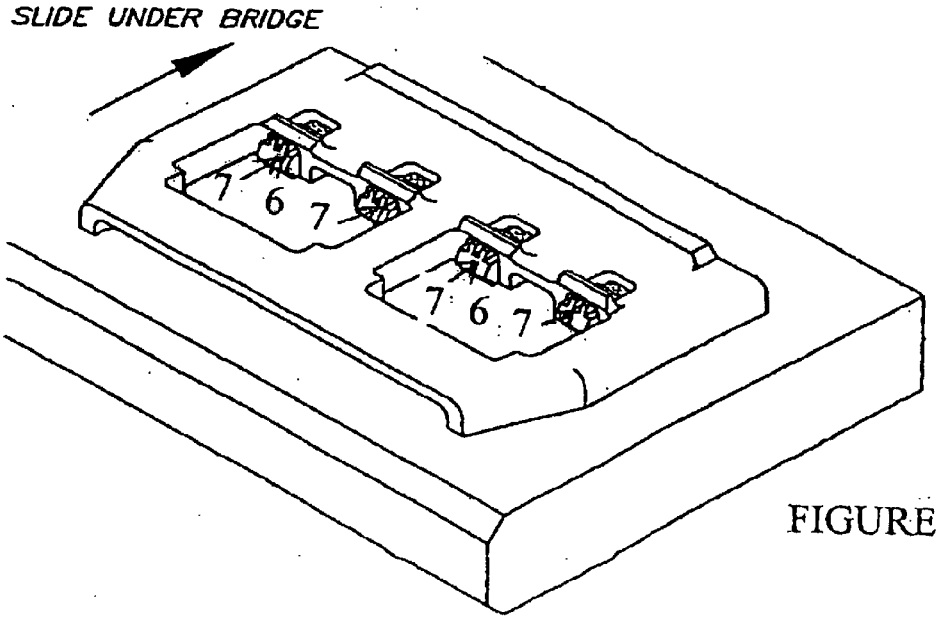
Figure 11C:
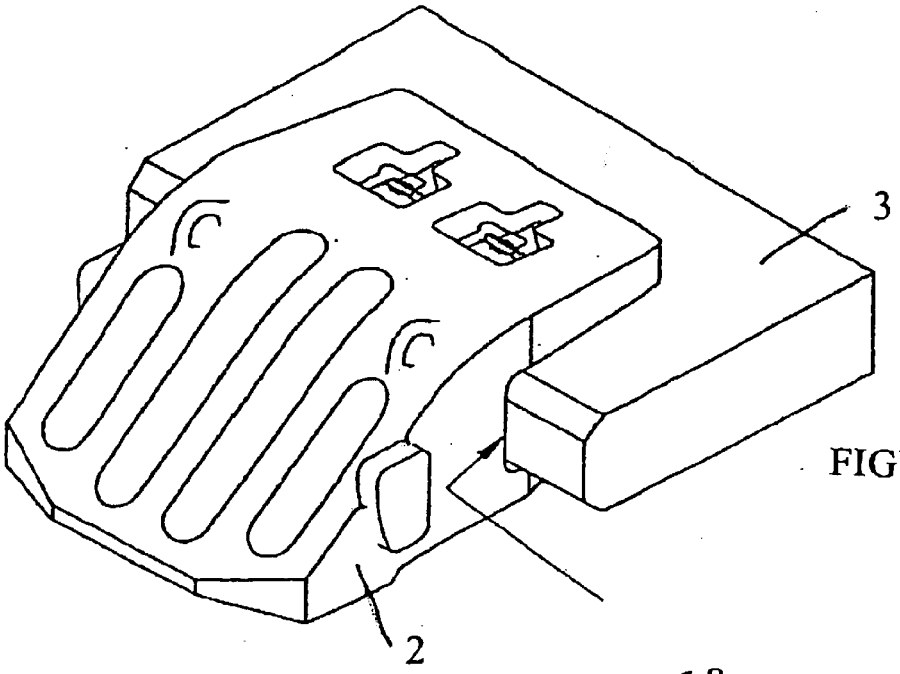
Figure 11D:
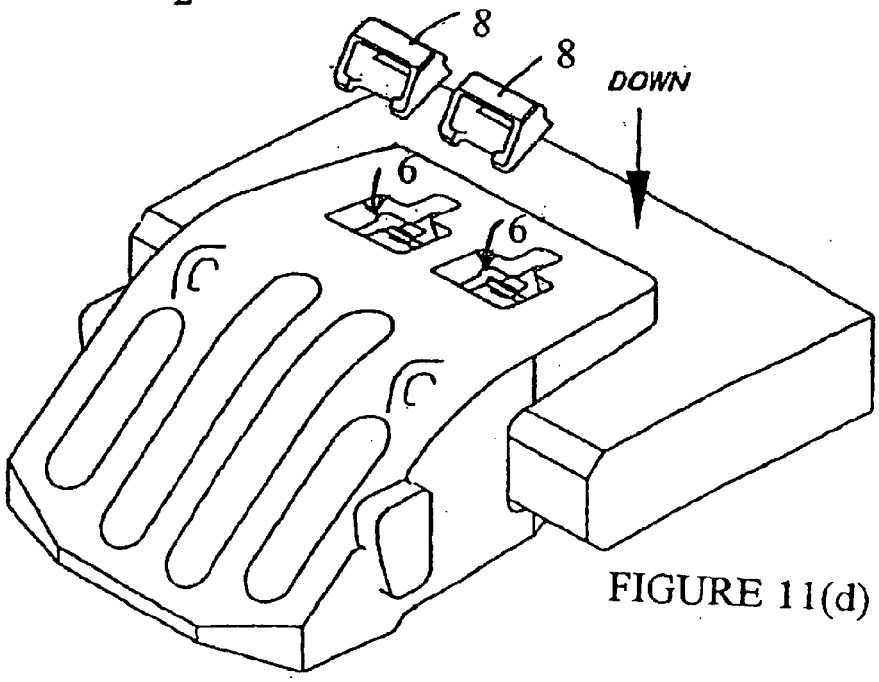

The cooperating parts 7 and 8 of the retaining means 4 are assembled by firstly providing the first part 7 into the position shown in FIG. 7 within the cooperating slots. Thereafter, the second part 8 is inserted in the manner illustrated in FIG. 8 to a position shown in FIG. 9 such that the lip 11 is forced past the protruding portion 12 of the first part 7 and is effectively locked in to position, locking the wear tooth 2 to the tooth adaptor 3. The inserted position of the retaining means is illustrated in schematic sectional view in FIG. 10.

To disassemble the wear tooth 2 from the tooth adaptor 3, a lever means is inserted into an orifice 15 provided in the second part 8 of retaining means 4. Once inserted, the lever is moved in a substantially arcuate manner, such that the second part 8 of retaining means 4 becomes disengaged from the first part 7 and is removed from slot 5. Once the second part 8 of retaining means 4 are both removed from each slot 5, the wear tooth 2 may be removed from the tooth adaptor 3.

It will be observed that, due to the design of the retaining means, the first part 7 need not be removed from the slot 6 in order to remove the tooth 2 from the tooth adaptor 3. Furthermore, due to the design of the first part 7, it is easily inserted into the slot 6 and retained therein in position, during insertion of the second part 8. Furthermore, during removal of the second part 8 of retaining means 4, when the lever is moved in the arcuate manner and the second part 8 rotatably is brought outwardly of slot 5, the front surface of first part 7 is against the inward surface of the tooth 2 ensuring easy removal of the second part 8 of retaining means 4.

It will be appreciated therefore that the present invention provides a unique locking assembly which, due to its design, is easily able to releasably secure a wear tooth 2 to a tooth adaptor 3. In use, the wear tooth of this design displays high structural integrity providing unrestricted flow of overburden during use of the tooth. The forces present in the locked position are illustrated by the arrows in FIG. 10. Minimal wear occurs at the side positions of the tooth 2, where the retaining means is removably inserted.

It will be appreciated that the retaining means may be inserted into position by imparting a force to the second part 8, and this may be provided by striking a hammer or the like against a striking pad 17.

It will be appreciated that the various components of the present invention may be constructed of a variety of materials, such as steel or other metal. The retaining means could, of course, be formed of other materials, such as plastics, and would be appropriately chosen depending upon the forces required to be sustained by those components, etc.

The present invention therefore provides a locking assembly 1, and a method for locking wear teeth 2 to an adaptor 3, which may be used in a variety of applications, such as earthmoving, mining, washery, crushing equipment, or other earthmoving equipment.

It will be appreciated that a variety of shapes of the various components may be provided whilst still achieving a similar functional operation.

For example, FIG. 11 illustrates an alternative embodiment of the present invention, whereby, for each pair of first parts 7 of the retaining means 4, a single or connected second part 8 is provided for insertion in the slot 6. FIG. 11(*a*) illustrates the first parts 7 ready for insertion, FIG. 11(*b*) shows the first parts 7 inserted in the slots 6, FIG. 11(*c*) illustrates the provision of the tooth 2 to the tooth adaptor 3, and FIG. 11(*d*) illustrates the final step of placement of the second parts 8 into the slots 7, whereby the tooth is thereafter connected to the tooth adaptor, ready for use.

Figure 12A:
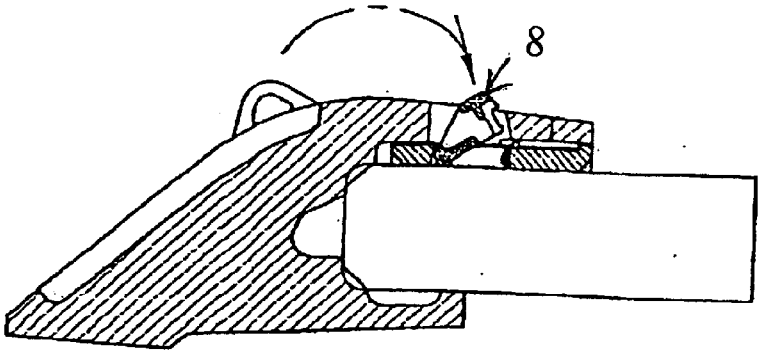
FIG. 12 illustrates a sectional view of the locking and unlocking of the embodiment illustrated in FIG. 11.
Figure 12B:
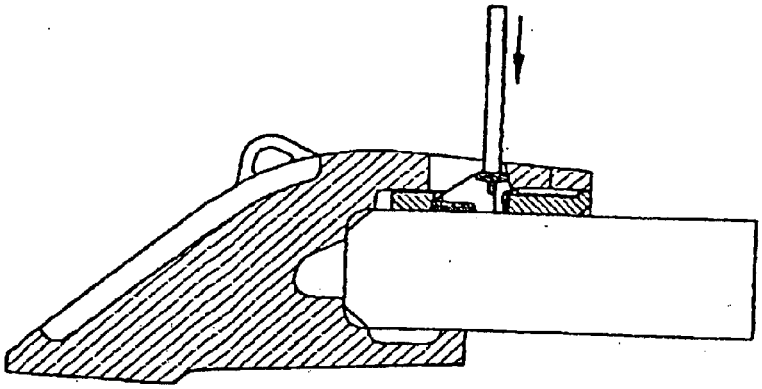
Figure 12C:
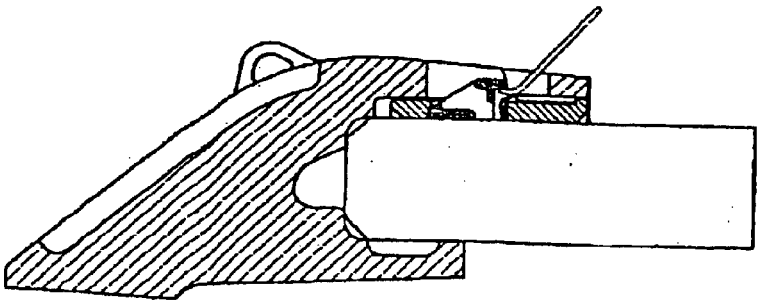

In FIG. 12 is shown how the second part is secured and released from its locked position. As shown in FIG. 12(*a*), the second part is inserted into position by rotating it into the slot 6, and then, as shown in FIG. 12(*b*), by striking it with an appropriate dolly and hammer until the clip locks into place. To remove, it may be levered out by a crows foot tool as shown in FIG. 12(*c*).

The arrangement of FIGS. 11 and 12 also highlights the positioning of the locking arrangement in an alternative position, that is, rather than in the side of the tooth, on the top surface.

Figure 13:
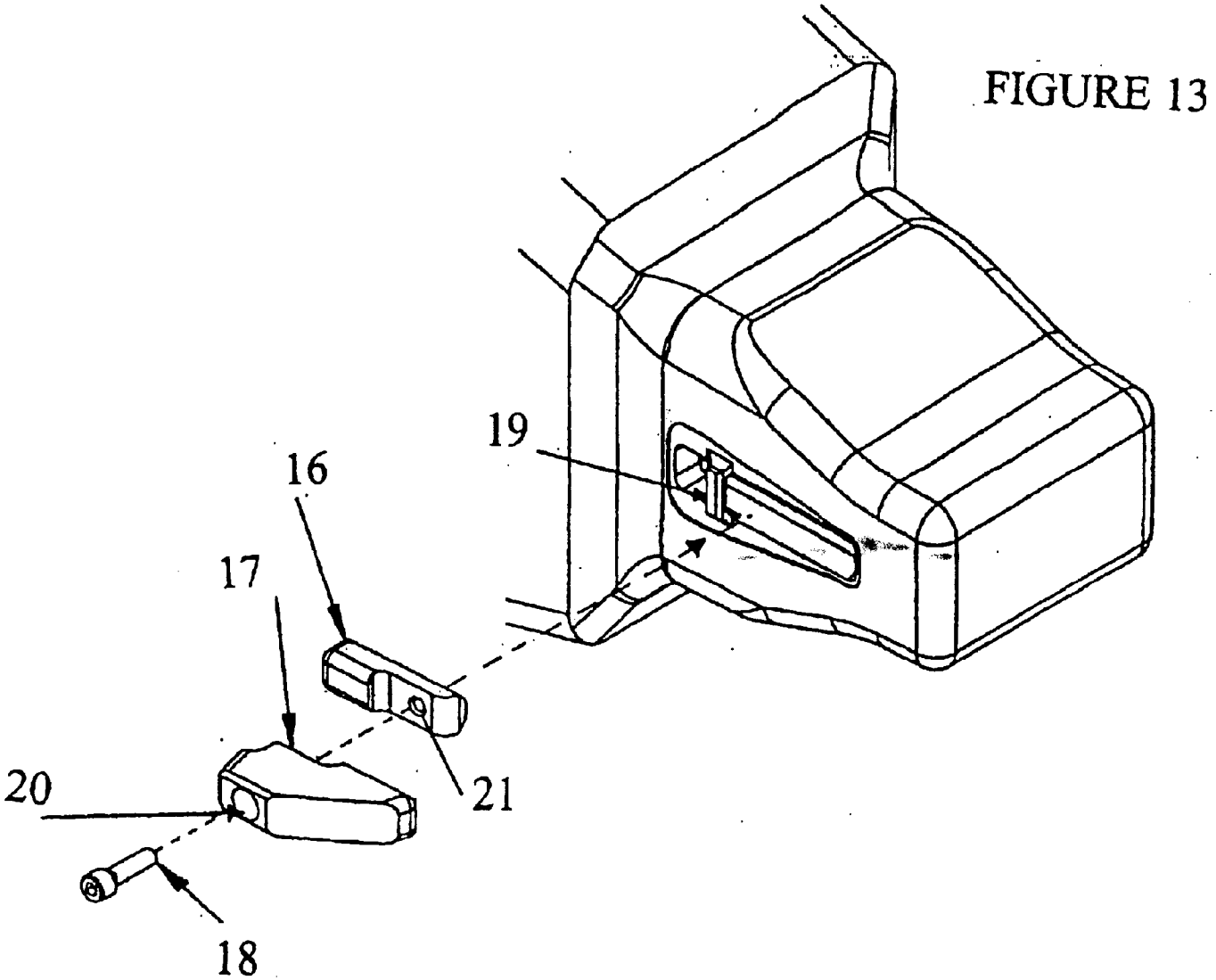
FIG. 13 illustrates an exploded view of another embodiment of the present invention including a first retainer piece, a second retainer piece, a locking piece, and a bracket piece extending across a portion of the wear tooth slot.
Figure 14:
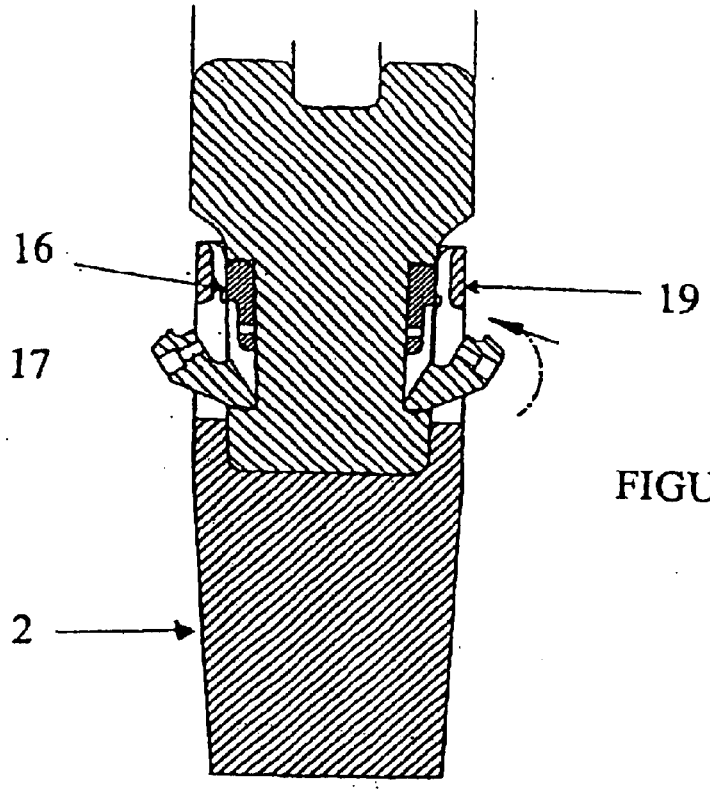
FIG. 14 illustrates a top view of another embodiment of the present invention in which the second retainer pieces are being pivotally inserted into the wear tooth slots and tooth adaptor cavities; and, FIG. 15 illustrates a top view of another embodiment of the present invention wherein the locking pin is releasably locking the retainer pieces together.
Figure 15:
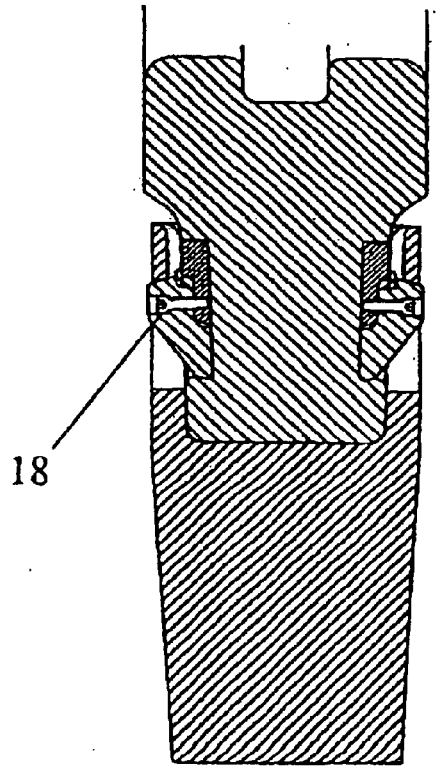

FIGS. 13, 14 and 15 show another embodiment of the present invention for releasably locking a wear tooth 2 to a tooth adaptor 3 in which a first retainer piece 16 and a second retainer piece 17 are held in place by a locking piece 18 which communicates with and releasably locks the first retainer piece 16 relative to the second retainer piece, and a rigid bracket or bridge 19 extending across a portion of the slot 6 to substantially brace the retainer pieces when in the locked position.

The first retainer piece 16 and the second retainer piece 17 each include threaded slots or holes, 21 and 20 respectively, which are substantially aligned when the retainer pieces 16 and 17 are installed in the wear tooth slot 6 and tooth adaptor cavity during locking. The locking piece 18 is a threaded-screw which complements the threaded-slots or holes of the first and second retainer pieces 16 and 17. The threaded-screw is inserted into the substantially aligned first retainer piece slot and second retainer piece slot during locking as shown in FIG. 15.

A shown in FIG. 13, the rigid bracket 19 is mounted to the adaptor 2 at two points on the adaptor surface so as to form a bridge, the position of the bracket piece 19 being selected by a person skilled in the art such that when the second retainer piece 17 is inserted into the wear adaptor 6 and tooth adaptor cavity and releasably locked to the first retainer piece 16, the bracket piece 19 will contact with the second retainer piece 17 so as to prevent any substantial movement of the retainer pieces 16 and 17.

All such variations and modifications of such nature should be considered to fall within the scope of the invention as broadly hereinbefore described and as hereinafter claimed.

What is claimed is:

1. A locking arrangement for releasably locking a wear tooth to a tooth adaptor, wherein the wear tooth comprises a cutting edge at a first end of the wear tooth, atop wall, a bottom wall and a pair of opposed sidewalls, each sidewall having an elongate slot therethrough disposed such that a longitudinal axis thereof extends in a direction substantially aligned cowards the cutting edge, and wherein the tooth adaptor is of substantially complementary shape to receive a second end of the wear tooth and comprises a pair of opposed walls and an elongate cavity on each opposed wall adapted to substantially align with a respective slot of the wear tooth when the wear tooth is installed on the tooth adaptor, the locking arrangement comprising:

retaining means adapted to be installed in each aligned cavity and slot to releasably lock the wear tooth to the tooth adaptor, wherein the retaining means comprises a first engaging retaining piece and a second engaging retaining piece adapted to fit in an end-abutting relationship when the engaging retaining pieces are in a locked position, and wherein the engaging retaining pieces are adapted to be released from the locked position upon an arcuate force being applied to the engaging retaining pieces.

2. The locking arrangement of claim 1, wherein a first end of the first engaging retaining piece comprises a protruding portion adapted to retain a rearwardly positioned up provided on a first end of the second engaging retaining piece when in the locked position, wherein the second engaging retaining piece is adapted to be pivoted about its second end by applying a force in an arcuate manner to the second engaging retaining piece to release the engaging retaining pieces from the locked position.

3. The locking arrangement of claim 2, wherein the second engaging retaining piece comprises an orifice adapted to receive a lever therein, such that the arcuately directed force is applied through the lever for release of the engaging retaining pieces.

4. The locking arrangement of claim 2, wherein the second engaging retaining piece includes a striking pad adapted for receiving a striking force to engage the engaging retaining pieces in the locked position.

5. The locking arrangement of claim 2, wherein the first end of the second engaging retaining piece includes a forward portion abutting an inner surface of the wear tooth slot, such that the forward portion is releasably retained in a forward direction when the engaging retaining pieces are in the locked position.

6. The locking arrangement of claim 2, wherein at least one of the engaging retaining pieces comprises an elastomeric material.

7. The locking arrangement of claim 2, wherein a second end of the first engaging retaining piece comprises an elastomeric material.

8. The locking arrangement of claim 1, wherein the retaining means additionally comprises a rigid bracket extending across at least a portion of the tooth adaptor cavity and a locking piece that communicates with, and releasably locks, the engaging retaining pieces relative to each other when installed in the aligned cavity and slot, wherein the bracket substantially restrains the engaging retaining pieces in the aligned cavity and slot.

9. The locking arrangement of claim 8, wherein a first end of the first engaging retaining piece comprises a protruding portion for receiving a rearwardly positioned lip provided on a first end of the second engaging retaining piece when the engaging retaining pieces are in a locked position.

10. The locking arrangement of claim 8, wherein the locking piece comprises a threaded screw.

11. The locking arrangement of claim 10, wherein each engaging retaining piece comprises a threaded hole for receiving the locking piece.

12. The locking arrangement of claim 11, wherein the threaded holes of each engaging retaining piece arc substantially aligned for mutually receiving the locking piece when the engaging retaining pieces are installed in the aligned wear tooth slot and tooth adaptor cavity.

13. The locking arrangement of claim 8, wherein the rigid bracket is removably mounted to the tooth adaptor.

14. The locking arrangement of claim 8, wherein the rigid bracket extends transversely across at least a portion of the adaptor slot.

15. A method for releasably locking a wear tooth to a tooth adaptor, wherein the tooth adaptor comprises a cutting edge at a first end of the tooth adaptor, a top wall, a bottom wall and a pair of opposed sidewall, each sidewall having an elongate slot therethrough disposed such that a longitudinal axis thereof extends in a direction substantially aligned towards the cutting edge, and wherein the tooth adaptor is of substantially complementary shape to receive a second end of the wear tooth, wherein the tooth adaptor comprises a pair of opposed walls and an elongate cavity on each, opposed wall adapted to substantially align with a respective slot of the wear tooth when the wear tooth is installed on the tooth adaptor, the method comprising the steps of:

installing a retaining means in each aligned cavity and slot to releasably lock the wear tooth to the tooth adaptor, wherein the retaining means comprises a first engaging retaining piece and a second engaging retaining piece adapted to fit in an end-abutting relationship when the engaging retaining pieces are in a locked position, and wherein the engaging retaining pieces are adapted to be released from the locked position upon an arcuate force being applied to the engaging retaining pieces.

16. The method of claim 15, further comprising the steps of positioning a lever in an orifice of the second engaging retaining piece and applying an arcuate force to the lever for releasing the engaging retaining pieces.

17. The method of claim 15, further comprising the step of imparting a striking force to a striking pad of the second engaging retaining piece to engage the engaging retaining pieces in the locked position.

18. The method of claim 15, further comprising the steps of extending a rigid bracket across at least a portion of the tooth adaptor cavity and releasably locking with a locking piece the engaging retaining pieces relative to each other when installed in the aligned cavity and slot, wherein the bracket substantially restrains the engaging retaining pieces in the aligned cavity and slot.

* * * * *